US012196059B2

(12) United States Patent
Maki et al.

(10) Patent No.: US 12,196,059 B2
(45) Date of Patent: Jan. 14, 2025

(54) SPLINE LUBRICATION FOR DTH HAMMERS

(71) Applicants: SANDVIK MINING AND CONSTRUCTION TOOLS AB, Sandviken (SE); SANDVIK MINING AND CONSTRUCTION OY, Tampere (FI)

(72) Inventors: Jorma Maki, Tampere (FI); Olivier Bruandet, Tampere (FI)

(73) Assignees: SANDVIK MINING AND CONSTRUCTION TOOLS AB, Sandviken (SE); SANDVIK MINING AND CONSTRUCTION OY, Tampere (FI)

( * ) Notice: Subject to any disclaimer, the term of this patent is extended or adjusted under 35 U.S.C. 154(b) by 0 days.

(21) Appl. No.: 17/925,861

(22) PCT Filed: May 19, 2021

(86) PCT No.: PCT/EP2021/063275
§ 371 (c)(1),
(2) Date: Nov. 17, 2022

(87) PCT Pub. No.: WO2021/233991
PCT Pub. Date: Nov. 25, 2021

(65) Prior Publication Data

US 2023/0184037 A1 Jun. 15, 2023

(30) Foreign Application Priority Data

May 19, 2020 (EP) ..... 20175331

(51) Int. Cl.
*E21B 4/14* (2006.01)
*E21B 10/36* (2006.01)
*E21B 6/04* (2006.01)

(52) U.S. Cl.
CPC ..... *E21B 4/14* (2013.01); *E21B 10/36* (2013.01); *E21B 6/04* (2013.01)

(58) Field of Classification Search
CPC ..... E21B 4/14; E21B 10/36; E21B 6/04
See application file for complete search history.

(56) References Cited

U.S. PATENT DOCUMENTS 5,396,965 A * 3/1995 Hall ..... E21B 4/14 173/78
5,685,380 A 11/1997 Purcell et al.
(Continued)

FOREIGN PATENT DOCUMENTS

EP 1757769 A1 2/2007
EP 2627850 A2 8/2013
(Continued)

*Primary Examiner* — Taras P Bemko
(74) *Attorney, Agent, or Firm* — Corinne R. Gorski

(57) ABSTRACT

A down the hole drilling assembly has a top end coupled to a drill string and a bottom cutting end. The drilling assembly includes a piston arranged moveably inside a casing with a piston nose positioned at an axially bottom end and a top working chamber at a top end, a bottom working chamber at the bottom end, a driver sub having axially extending driver sub splines on an internal surface, a drill bit having an axially extending central bore including an elongate shank provided with axially extending shank splines on its outer surface for engagement with the driver sub splines to form a spline area, a guide sleeve forming a seal with the piston nose, the guide sleeve having an inner and outer surface, and at least one air passageway extending through the guide sleeve for fluidly connecting the bottom chamber to the spline area to provide lubrication thereto.

11 Claims, 9 Drawing Sheets

(56) References Cited

U.S. PATENT DOCUMENTS

| | | | | |
|---|---|---|---|---|
| 2005/0252671 | A1* | 11/2005 | Gien | E21B 4/14 173/91 |
| 2009/0183919 | A1* | 7/2009 | Hall | E21B 10/62 175/57 |
| 2010/0012380 | A1 | 1/2010 | Swadi | |
| 2010/0200301 | A1* | 8/2010 | Lyon | E21B 4/14 175/296 |

FOREIGN PATENT DOCUMENTS

| | | | |
|---|---|---|---|
| WO | 2007077547 | A1 | 7/2007 |
| WO | 2012056434 | A1 | 5/2012 |

* cited by examiner

SPLINE LUBRICATION FOR DTH HAMMERS

RELATED APPLICATION DATA

This application is a § 371 National Stage Application of PCT International Application No. PCT/EP2021/063275 filed May 19, 2021 with priority to EP 20175331.6 filed May 19, 2020.

TECHNICAL FIELD

The present invention relates to a down-the-hole hammer drill bit assembly arranged to provide improved spline lubrication.

BACKGROUND

Holes can be drilled in rock by means of various rock drilling assemblies. Drilling may be performed with a method of combining percussions and rotation. This type of drilling is called percussive drilling. Percussive drilling may be classified according to whether an impact device is outside the drill hole or in the drill hole during drilling. When the impact device is in the drill hole, the drilling is typically called down the hole (DTH) drilling. Since the impact device in the DTH drilling assembly is located inside the drill hole, the structure of the impact device needs to be compact.

The technique of DTH percussive hammer drilling involves the supply of a pressurised fluid via a drill string to a hammer located at the bottom of a bore hole. The fluid acts to both drive the hammer drilling action and to flush chips and fines resultant from the cutting action, rearwardly through the bore hole so as to optimise forward cutting.

The drilling assembly is provided with a reciprocating percussion piston, which is moved by controlling the feeding and discharging of pressurized fluid into and out of working chambers where the working surfaces of the piston are located. The piston is configured to strike a drill bit being connected directly to the drilling assembly. The most common way to provide rotational driving between the shaft of the drill bit and the driver sub is to use splines both on the exterior of the shaft and on the wall of the bore of the driver sub. It is important that these splines are lubricated, for example by a containing lubricant, in order to prevent galling which would result in damage to and the formation of cracks in the surfaces of the splines.

Traditionally, splines get lubricated via leakage of air from the working chambers. For DTH hammers that have a foot valve, the bottom chamber is sealed off from the foot valve and top diameter of the bit. This creates a buildup of pressure and consequently there will be some leakage of air which will flow into the spline area to ensure lubrication.

Foot valves are typically made of plastic and prone to breaking, therefore it is advantageous to avoid the inclusion of this part to reduce the downtime that would be required to replace broken parts. Therefore, in some DTH hammer designs the foot valve and piston cooperation of earlier designs has been replaced by the nose of the piston creating the sealing with the bore of a bushing. For example this is shown in EP2627850.

However, for DTH hammers that do not have a foot valve, as the bottom chamber sealing is done by the piston nose there is no buildup of high pressure anywhere on the outside surface of the bit. Only during chamber venting will there be air, and even then only for short period, creating some pressure on the outside of the bit, but because the bit center bore offers the path of least resistance this means only very minimal air flow is directed towards the splines, which does not provide sufficient lubrication for the splines. In foot valve less DTH hammers the guide bushing or the top end of the drill bit is provided with scallops to create an air passage for spline lubrication, however the lubrication provided via this means is not sufficient. Therefore, there is need, especially for larger drill bit sizes, to provide a foot valve less drilling bit assembly where there is an increased air flow to the splines in order to provide better lubrication to this region.

SUMMARY

It is an objective of this invention to provide a novel and improved percussive drilling assembly and apparatus for drilling rock whereby there is increased lubricated provided to the splines.

The objective is achieved by providing a down the hole drilling assembly comprising a down the hole drilling assembly having a top end arranged for coupling to a drill string and bottom cutting end, the drilling assembly comprising: an elongate casing; a fluid powered piston arranged moveably inside the casing which is capable of shuttling axially back and forth having a piston nose positioned at its axially bottom end; a top working chamber at the top end side of the piston and a bottom working chamber at the bottom end side of the piston; a driver sub provided with a set of axially extending driver sub splines on its internal surface; a drill bit having a central bore extending axially therethrough comprising an elongate shank provided with a set of axially extending shank splines on its outer surface for engagement with the driver sub splines to form a spline area; a guide sleeve for forming a first seal with the piston nose wherein the guide sleeve has an inner surface and an outer surface; characterized in that: the guide sleeve forms a second seal with the outer surface of the shank of the drill bit and wherein there is at least one air passageway extending through the guide sleeve and/or the casing for fluidly connecting the bottom chamber to the spline area to provide lubrication thereto.

Advantageously, this means that air is forced to the splines and therefore lubrication of the splines is improved. Consequently, galling is reduced and so the cracking and damage to the surfaces of the splines is minimized. Additionally the increased air flow to the spline area aids in flushing dirt and other debris away, which will improve the lifetime of the components.

Optionally, the first seal and/or second seal are strengthened with an additional sealing medium, such as a piston seal or rod seal. Advantageously, this will improve the strength of the sealing.

Optionally, the air passageway extends exclusively through the guide sleeve. Advantageously, this is easier to manufacture.

Preferably, the guide sleeve has a first section at its axial top end, a second section in axial central region and a third section at its axial bottom end and wherein the air passageway is formed from:

- at least one top end port located in the first section that extends from a first distal end on an inner surface of the guide sleeve to a second distal end on the outer surface of the guide sleeve and wherein the first distal end is fluidly connected to the bottom chamber;
- at least one channel positioned in the second section formed between an inner surface of the casing and the outer surface of the guide sleeve that is fluidly connected to the at least one top end port;

at least one groove positioned in the outer surface of the third section or at least one bottom end port extending through the third section that is fluidly connected to the channel and the spline area.

Advantageously, this arrangement will provide a good air passageway from the bottom chamber to the spline area without compromising the effectiveness of the guide sleeve to provide alignment between the drill bit and the piston nose.

Preferably there are at least 3 top end ports. Advantageously, this will provide an increased flow of air to the spline area.

Preferably, the top end ports are evenly spaced around the circumference of the guide sleeve. Advantageously, this will provide a well distributed flow of air to the whole of the spline area.

Preferably, the at least one top end port projects at an angle such that the first distal end is nearer the top end of the guide sleeve and compared to the second distal end. Advantageously, this will provide the good fluid pathway for the air to flow from the bottom chamber to the channel in the second section of the guide sleeve.

Preferably, the at least one channel is formed by the outer surface of the guide sleeve being recessed radially inwardly around the entire circumference of the guide sleeve. Advantageously, this structure provides a good air passageway from the top end ports to the grooves or bottom end ports without compromising the strength and effectiveness of the guide sleeve to provide alignment between the drill bit and the piston nose and is easy to manufacture.

Alternatively, the at least one channel is formed by axial sections of the outer surface of the guide sleeve being recessed radially inwardly.

Preferably, there are at least 2 grooves or bottom end ports. Advantageously this will distribute the flow more evenly among the splines.

Alternatively, the air passageway extends through the guide sleeve and the casing. In which case, optionally the air passageway is formed from at least one top end port located in the first section of the guide sleeve and a recess on the inner side of the casing. This alternative could be used for designs where the guide sleeve is thin and therefore there is limited material thickness for the air passageway to extend exclusively through the guide sleeve.

Alternatively, the air passageway extends exclusively through the casing via the recess on the inner side of the casing. This alternative could be used for designs where the guide sleeve is thin and therefore there is limited material thickness for the air passageway to extend through the guide sleeve.

Optionally, the driver sub and/or drill bit has a slot adjacent to a gap between the shank of the drill bit and the driver sub for the air from the spline area to leak through to the outside of the assembly. Advantageously, this will increase the leakage flow and therefore the lubrication.

BRIEF DESCRIPTION OF THE DRAWINGS

A specific implementation of the present invention will now be described, by way of example only, and with reference to the accompanying drawings in which.

DETAILED DESCRIPTION

Figure 1:
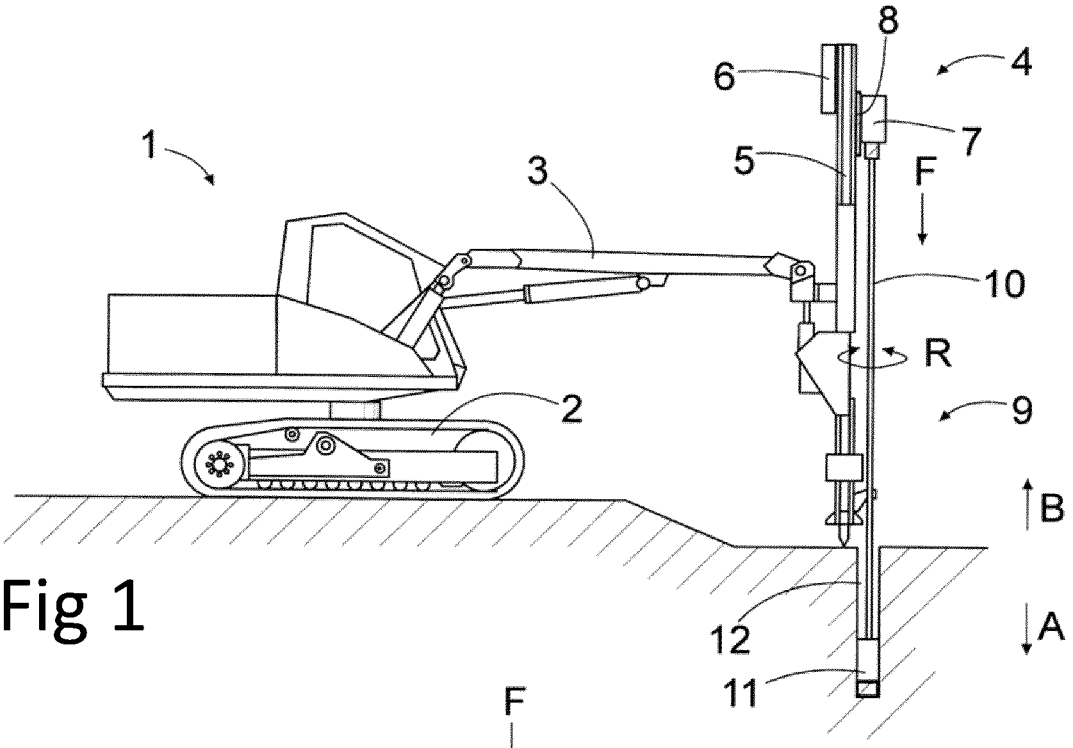
FIG. 1: shows a schematic drawing of a rock drilling rig provided with a DTH rock drilling assembly.
Figure 2:
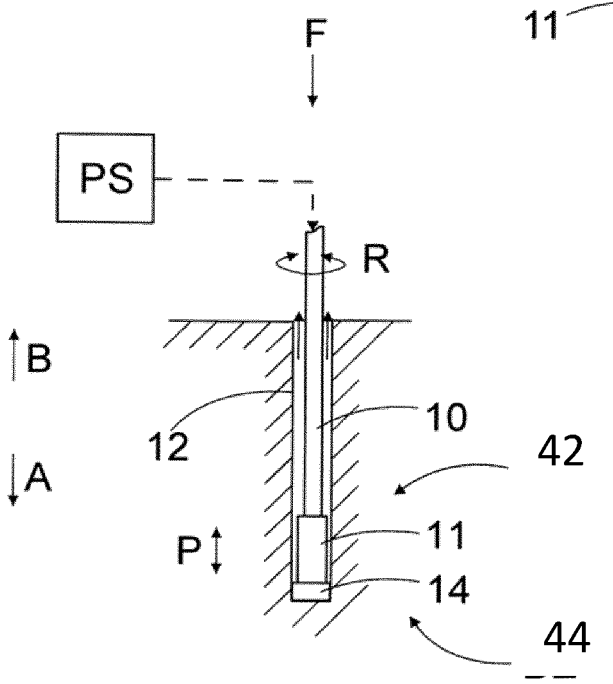
FIG. 2: shows a schematic drawing of a DTH drilling assembly at the bottom of a drill hole.

FIGS. 1 and 2 show a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and at least one rotating motor. The rotation unit 7 may be supported by a carriage 8 with which it is movably supported to the feed beam 5. The rotation unit 7 may be provided with drill string 9 which may comprise at least one drilling tube 10 connected to each other, and a DTH drilling assembly 11 at an outermost end of the drilling equipment 9. The DTH drilling assembly 11 is located in the drilled bore hole 12 during the drilling.

FIG. 2 indicates a top end 42 or axially rearward end of the drilling assembly 11 and bottom end 44 or axially forward end of the drilling assembly. The DTH drilling assembly 11 comprises an impact device (not shown). The impact device is at the opposite end of the drill string 9 in relation to the rotation unit 7. During drilling, a drill bit 14 is connected directly to the impact device, whereby percussions P generated by the impact device are transmitted to the drill bit 14. The drill string 9 is rotating around its longitudinal axis in direction R by means of the rotation unit 7 shown in FIG. 1 and, at the same, the rotation unit 7 and the drill string 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling assembly 11 through the drilling tubes 10. The pressurized fluid may be compressed air and the pressure source PS may be a compressor. The pressurized fluid is directed to influence to working surfaces of a percussion piston 19 (shown on FIG. 3) of the drilling assembly and to cause the piston 19 to move in a reciprocating manner and to strike against impact surface of the drill bit. After being utilized in working cycle of the drilling assembly 11 pressurized air is allowed to discharge form the drilling assembly 11 and to thereby provide flushing for the drill bit 14. Further, the discharged air pushes drilled rock material out of the drill hole in an annular space between the drill hole and the drill string 9. Alternatively, the drilling cuttings are removed from a drilling face inside a central inner tube passing through the impact device. This method is called reverse circulation drilling.

Figure 3:
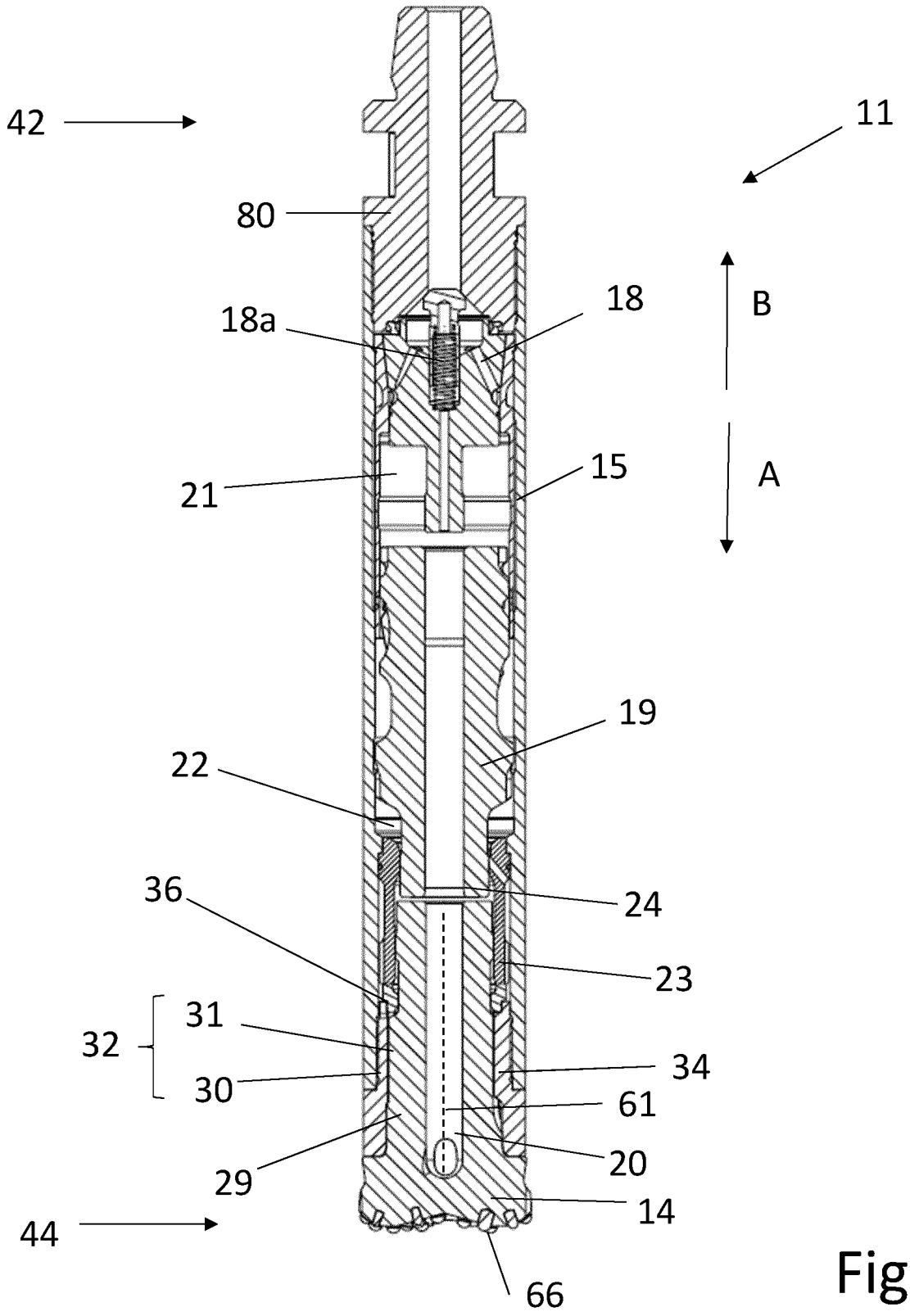
FIG. 3: shows a schematic drawing of a cross section of the DTH drilling assembly.

FIG. 3 shows a cross section of a DTH drilling assembly 11. The drilling assembly 11 comprises an elongate casing 15, which may be a relatively simple sleeve-like frame piece in the form of a substantially hollow cylinder. The drill bit 14 is at least partially accommodated within the bottom end 44 of the casing 15. At a top end 42 of the casing 15 a top sub (or connection piece) 80 is mounted providing means for the drilling assembly 11 to be connected to a drill tube (not shown). The top sub 80 is at least partially accommodated within the top end 42 of the casing 15. In connection with the top sub 80 is an inlet port 18 for feeding pressurized fluid to the impact device 13. The inlet port 18 may comprise a valve means 18*a*, which allows feeding of fluid towards the impact device but prevents flow in an opposite direction. The piston 19, which is substantially an elongated cylinder extends axially within the casing 15 and is capable of shuffling back and forth longitudinally through the DTH drilling assembly 11. The bottom end 44 of the piston 19 is arranged adjacent to the drill bit 14. The drill bit 14 is provided with a central, axially extending, bore 20 forming a passageway for flushing medium to flow through. The central bore 20 has a centre line 61.

At the top end 42 side of the piston 19 is a top working chamber 21 and at the opposite end, towards the bottom end 44, is a bottom working chamber 22. Movement of the piston 19 is configured to open and close fluid passages for feeding and discharging the working chambers 21, 22 and to thereby cause the piston 19 to move towards an impact direction A and return direction B. At the bottom end 44 of the piston 19 is the piston nose 24.

The drill bit 14 is provided with a plurality of tungsten carbide inserts 66. The drill bit 14 is formed with an axially extending shank 29. The shank 29 is provided with a set of axially extending shank splines 31 on its outer surface. Rotational force is applied to the drill bit 14 through a hollow, cylindrical driver sub 34 (otherwise known as the chuck), which is also provided with a set of axially extending driver sub splines 30 on its inner surface which engage with the shank splines 31 to transmit rotational drive from the driver sub 34 to the drill bit 14. The region where the driver sub splines 30 and the shank splines 31 engage is referred to as the spline area 32. Air needs to be delivered to the spline area 32 to provide lubrication thereto.

The assembly further comprises a bit retaining ring 36, which is typically formed in two half annular parts for ease of assembly which functions to prevent the drill bit 14 from disengaging with the remaining components of the drilling assembly 11, such as the casing 15.

A guide sleeve 23 (otherwise known as a bushing or guide bushing), which is used in place of a foot valve, is arranged to co-operate with the piston nose 24. The guide sleeve 23 is positioned radially inward and adjacent to the casing 15. The piston nose 24 is able to pulse in and out of the guide sleeve 23 at its top end 42 and the shank 29 of the drill bit 14 is partially enclosed inside the guide sleeve 23 at its bottom end 44. The purpose of the guide sleeve 23 is to align the drill bit 14 with the piston nose 24 to help stabilise, guide and provide a timing event for the piston 19.

Figure 4:
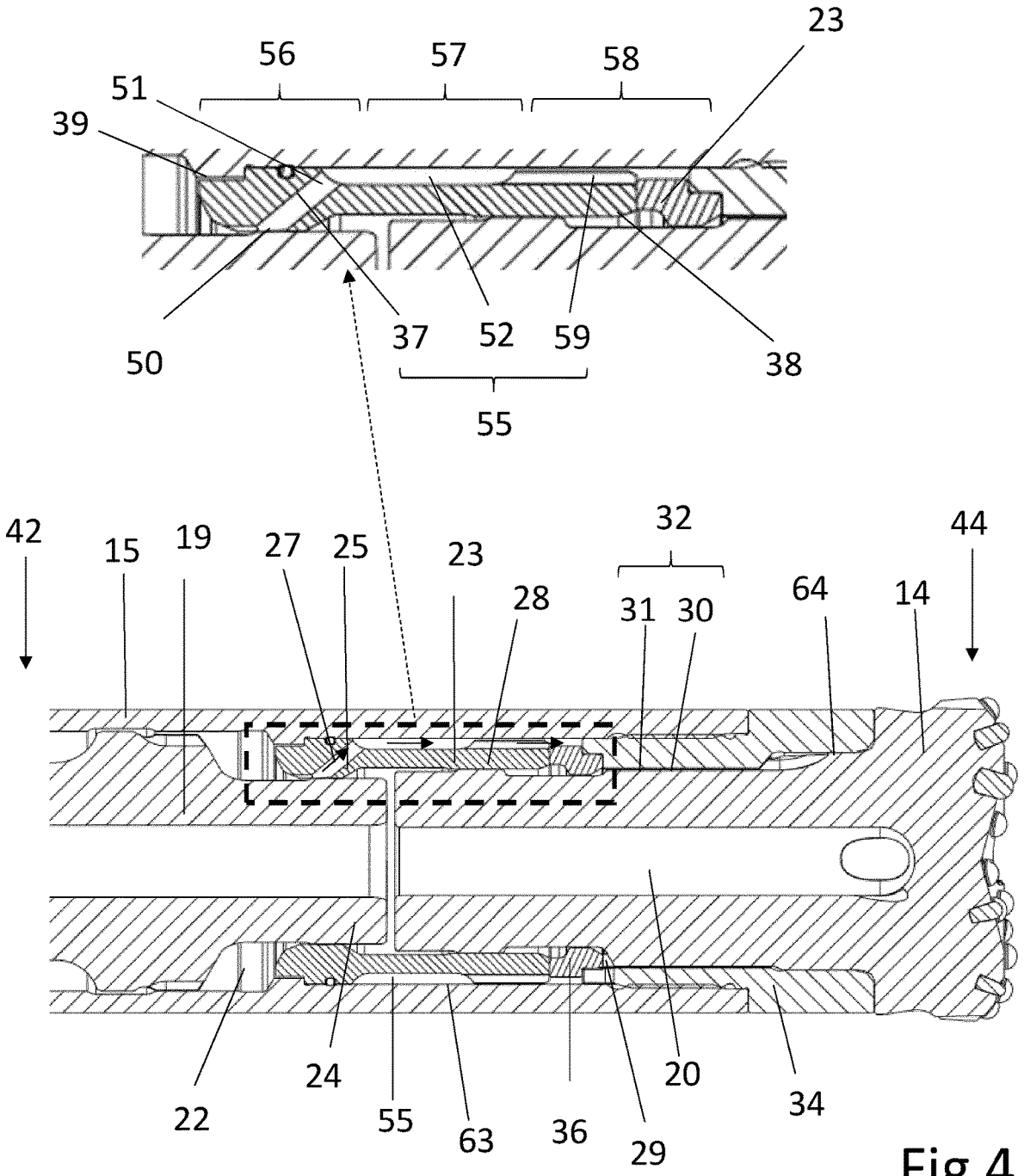
FIG. 4: shows an enlargement of the a cross section of the DTH drilling assembly in the region of the guide sleeve wherein the air passageway exclusively extends through the guide sleeve.

FIG. 4 shows an enlargement of the cross section of the drilling assembly in the region of the guide sleeve 23. A first seal 25 is formed between the guide sleeve 23 and the piston nose 24 and a second seal 28 is formed between the guide sleeve 23 and the outer surface of the shank 29 and the drill bit 14. Therefore a seal is created between the central bore 20 and the outer surface of the shank 29. This means that the main air flushing path (through the central bore 20) is separated from the spline area 32. Typically, the first and second seals 25, 28 are created by having a tight clearance in these regions. Optionally, the first and/or second seals 25, 28 can be strengthened by introducing an additional sealing medium, such as a polymer, a piston seal or rod seal or other suitable material. The guide sleeve 23 has an inner surface 38 which is adjacent to the piston nose 24 and an outer surface 39, which is adjacent to the casing 15. The guide sleeve 23 has been specially adapted to have an air passage 55 which allows air to flow directly from the bottom chamber 22 to the spline area 32. The flow of air along the air passageway 55 from the bottom chamber 22 to the spline area 32 is indicated on FIG. 4 by arrows 27.

The guide sleeve 23 comprises at least one air passageway 55 that fluidly connected the bottom chamber 22 to the spline area 32 to provide lubrication thereto. Preferably, the at least one guide sleeve 23 can be considered to be made up of three sections. In a first section 56, at the top end 42 of the guide sleeve 23, there is at least one top end port 37 that projects from a first distal end 50 on an inner surface 38 of the guide sleeve 23, to a second distal end 51 on the outer surface 39 of the guide sleeve. Preferably, the at least one top end port 37 projects at an angle such that the first distal end 50 is nearer the top end 42 of the guide sleeve 23 and compared to the second distal end 51. Preferably, there is more than one port 37, such as 3 or more, or such as 4 or more, or such as 5 or more. The number and size of the top end port(s) 37 can be varied to facilitate the required volume of air being delivered to the spline area 32. Preferably, the top end ports 37 are evenly spaced around the circumference of the guide sleeve 23. In a second section 57, at a central portion of the guide sleeve 23, the outer surface 39 is scalloped or recessed radially inwardly so that at least one channel 52 is formed between an inner surface 63 of the casing 15 and the outer surface 39 of the guide sleeve 23 around either the entire circumference or in axial sections of the guide sleeve 23, such that grooves are formed. The channel 52 is fluidly connected to the at least one top end port 37. In a third section 58, at the bottom end 44 of the guide sleeve 23, there is at least one groove 59 in the outer surface 39 of the guide sleeve 23. The at least one groove 59 extends axially along the outer surface 39 of the guide sleeve in the third section 58 to fluidly connect the channel 52 to the spline area 32. Preferably, there is more than one groove 59, such as at least 2 grooves, more preferably at least 3 grooves. The number and dimensions of the groove 59 can be varied to facilitate the required volume of air being delivered to the spline area 35. In one embodiment the air passageway 55 is formed from the at least one top end port 37, the at least one channel 52 and the at least one groove 59.

Figure 5:
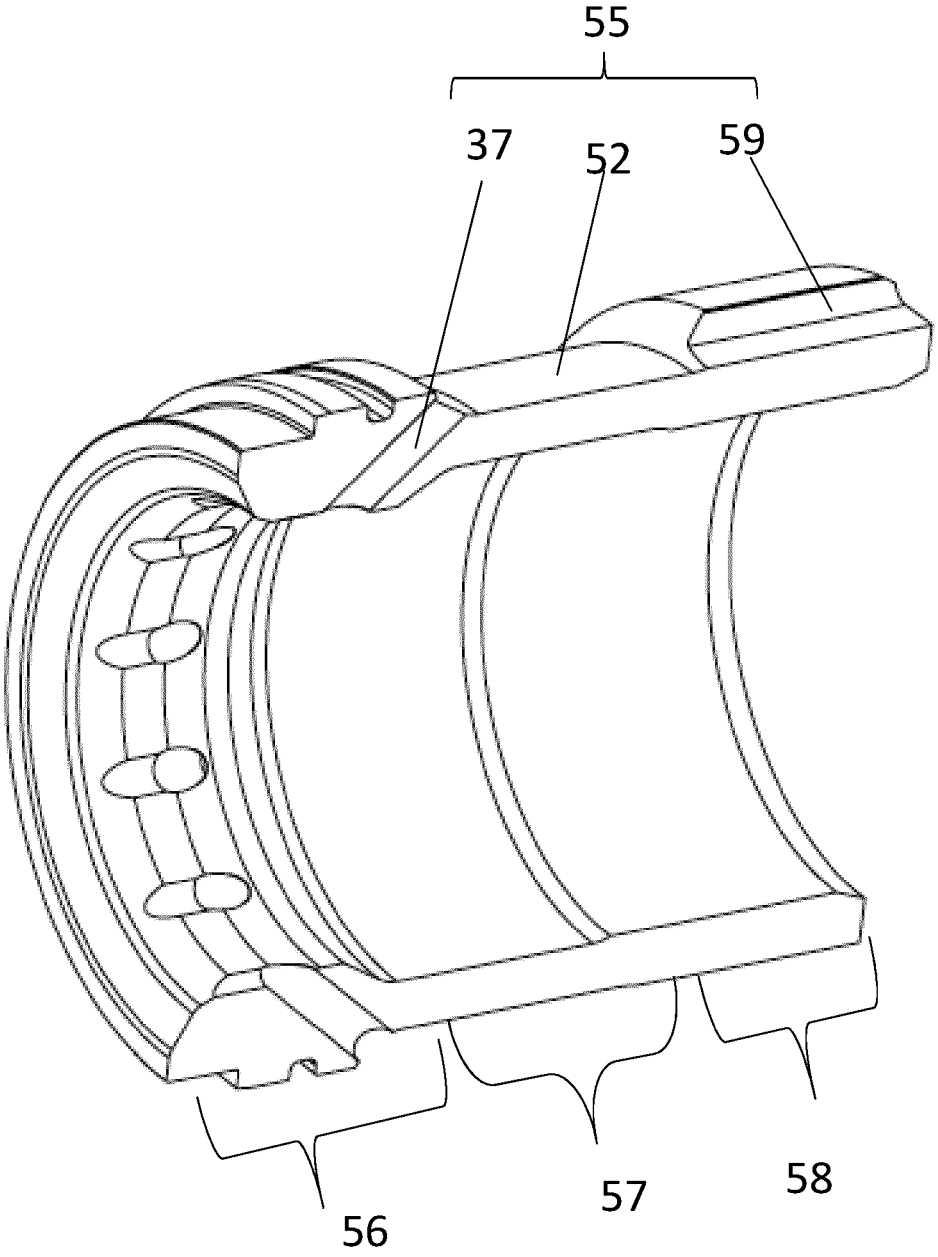
FIG. 5: shows a cross section of a perspective view of the guide sleeve according to one embodiment of the present invention.

FIG. 5 shows the guide sleeve 23 of the present invention more detail.

Alternatively, the at least one top end port 37 in the first section 56 could be replaced by a passageway between the casing 15 and the guide sleeve 23.

Alternatively, the at least one channel 52 in the second section 57 could be replaced by at least one axial hole projecting through the guide sleeve 23.

Figure 6:
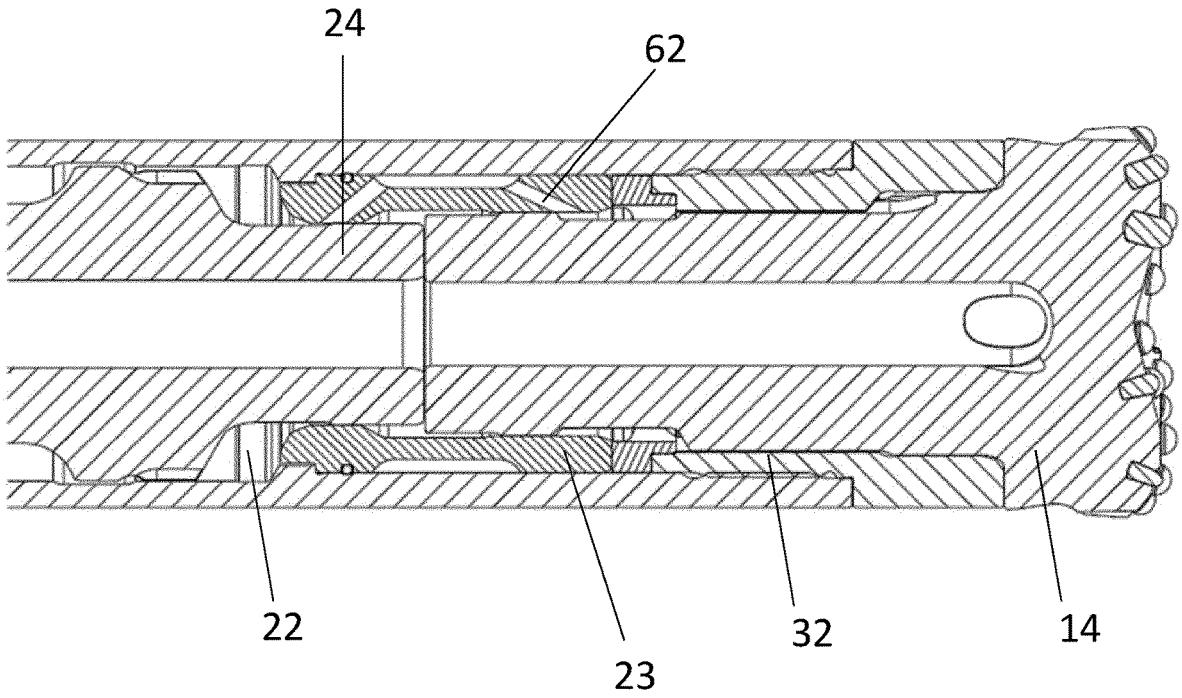
FIG. 6: shows a cross section of the DTH drilling assembly in the region of the guide sleeve according to an alternative embodiment of the present invention.

FIG. 6 shows that alternatively, the at least one groove 59 in the third section 58 could be replaced by at least one bottom end port 62.

The number of top end ports 37 in the first section 56 could be the same or different to the number of grooves 59 or bottom end ports 62 in the third section 58.

As the piston nose 24 moves out of the guide sleeve 23 the bottom chamber 22 is vented and so all air passes through the central bore 20. As the piston nose 24 moves into the guide sleeve 23, just before the striking point, pressurized air in the bottom chamber 22 becomes fluidly connected to the air passageway 55 via the at least one top end port 37. The design of the piston nose 24 can also be used to control the injection of air to the spline are 32.

Figure 7:
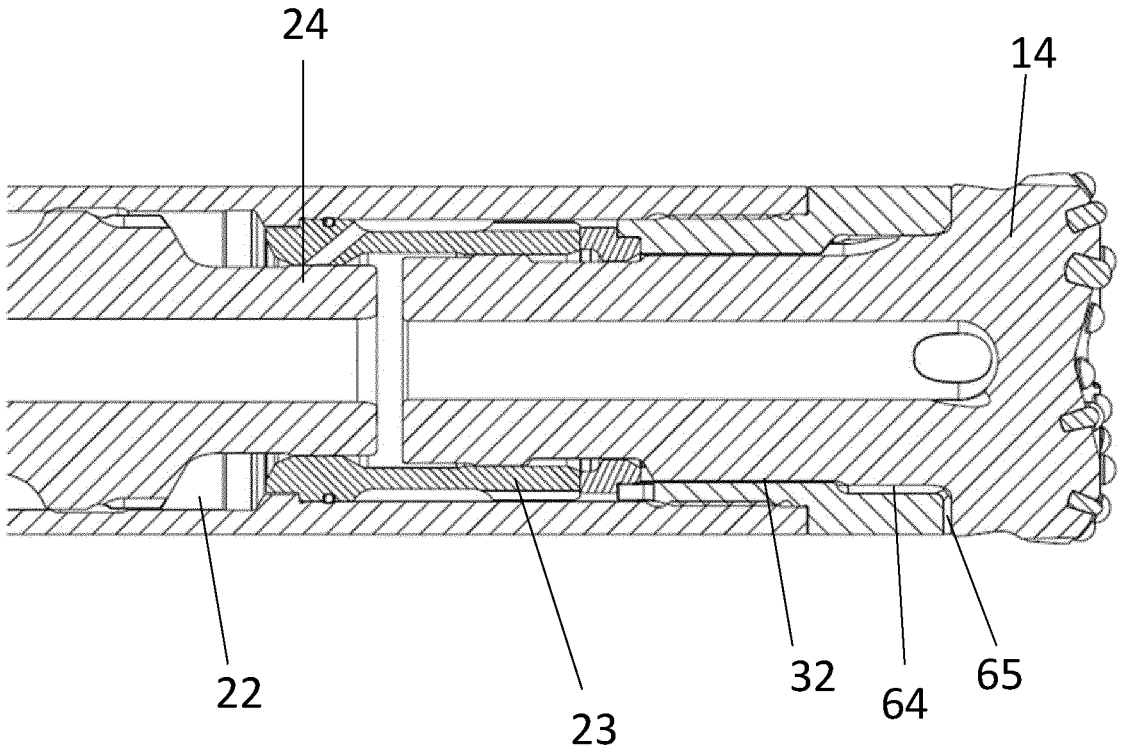
FIG. 7: shows a cross section of the DTH drilling assembly in the region of the guide sleeve wherein there is a slot on the driver sub.
Figure 8:
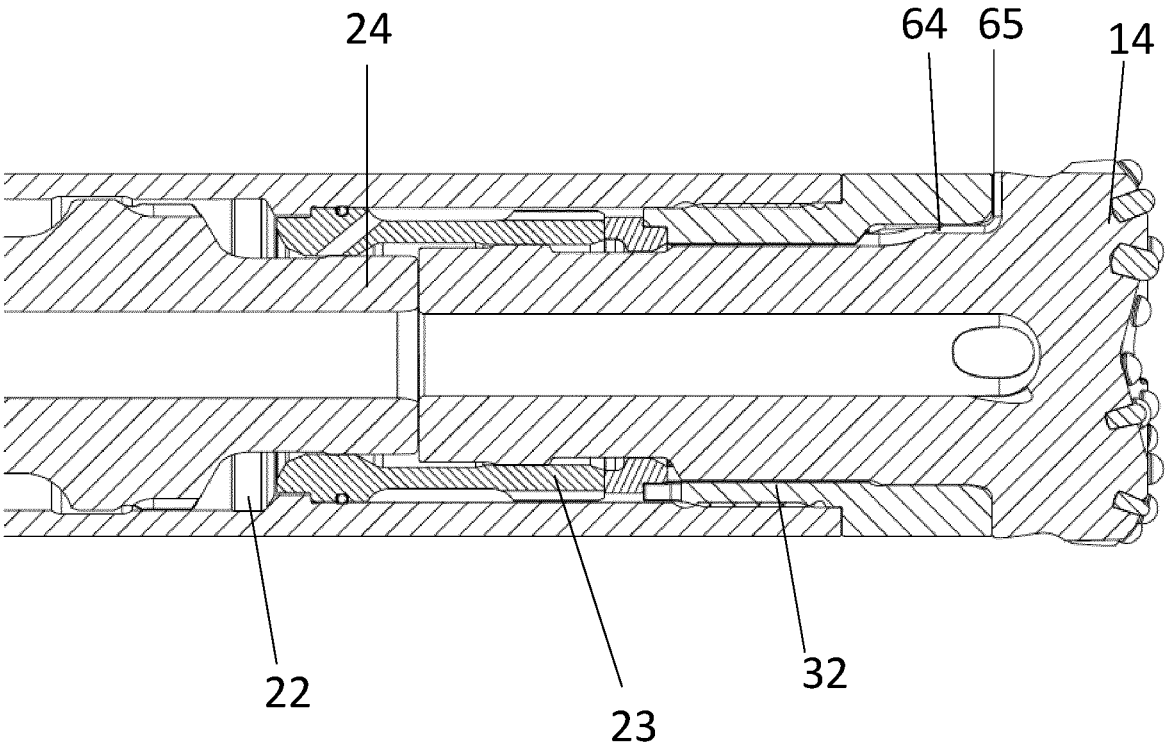
FIG. 8: shows a cross section of the DTH drilling assembly in the region of the guide sleeve wherein there is a slot on the drill bit.

Once the air has passed through the spline area 32 it will leak to the outside of the assembly 11 through a gap 64 between the shank 29 on the drill bit 14 and the driver sub 34. Additional flow area can be provided either by adding a slot 65 adjacent to the gap 64 on the driver sub 34, as shown in FIG. 7 or on the drill bit 14 as shown in FIG. 8 or a combination of both to further increase the leakage and therefore further increase the lubrication.

Figure 9:
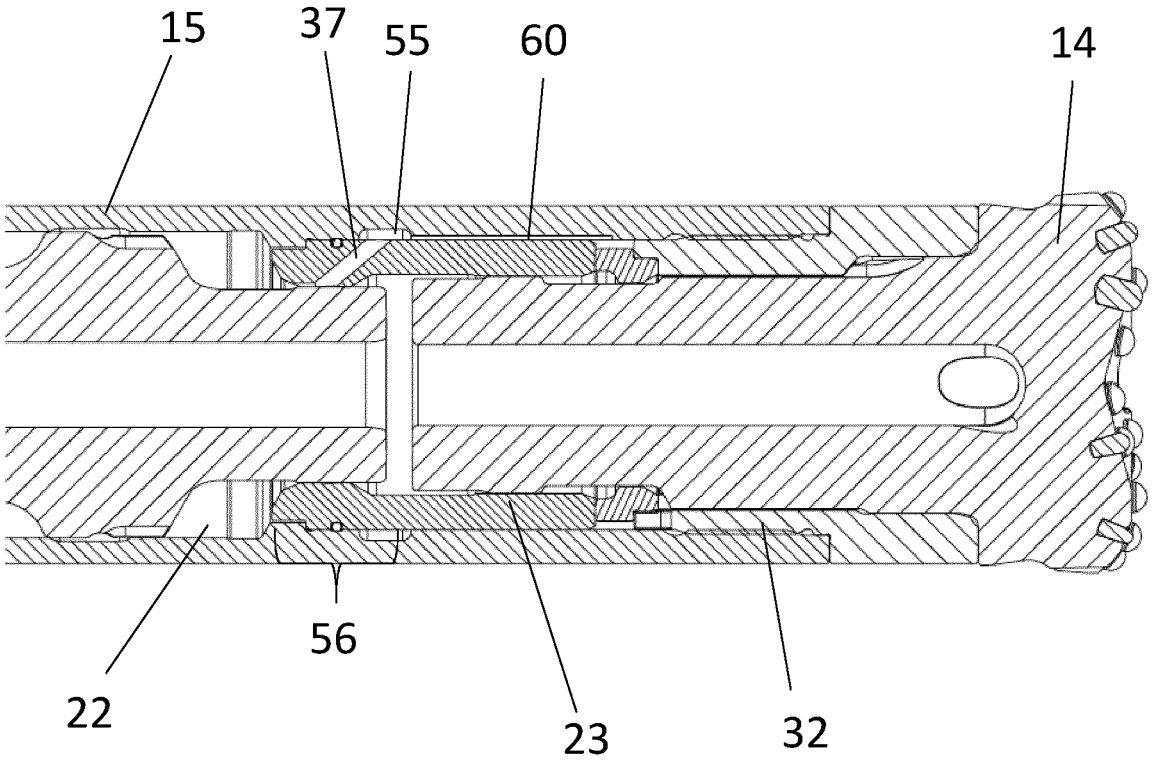
FIG. 9: shows a cross section of the DTH drilling assembly in the region of the guide sleeve wherein the air passageway extends through the guide sleeve and the casing.

FIG. 9 shows that alternatively the air passageway 55 may extend partially through the guide sleeve 23 and partially through the casing 15. For example, the air passageway 55 may be formed from at least one top end port 37 located in the first section 56 of the guide sleeve 23 and a recess 60 on the inner side of the casing 15.

Figure 10:
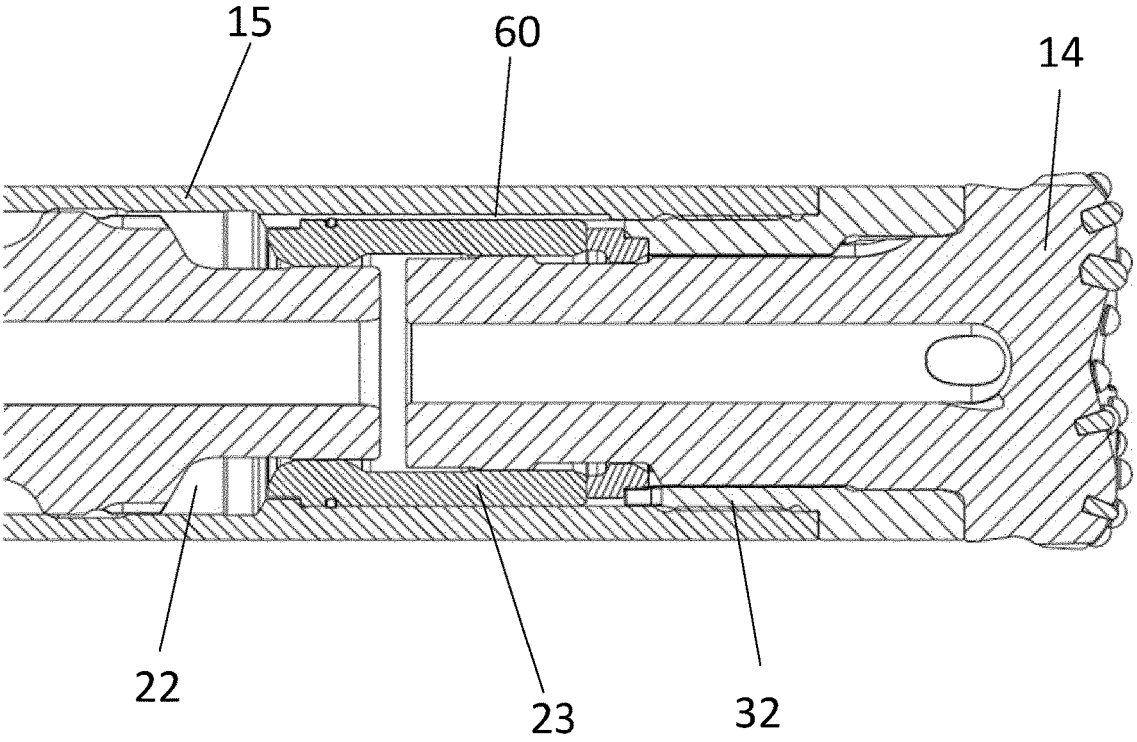
FIG. 10: shows a cross section of the DTH drilling assembly in the region of the guide sleeve wherein the air passageway extends through exclusively the casing.

FIG. 10 shows that alternatively the air passageway 55 may extend entirely and exclusively through the casing 15 to fluidly connect the bottom working chamber 22 to the spline area 32 via the recess 60 on the inner side of the casing 15.

The invention claimed is:

1. A down the hole drilling assembly having a top end arranged for coupling to a drill string and bottom cutting end, the drilling assembly comprising:

an elongate casing;

a fluid powered piston arranged moveably inside the casing, which is capable of shuttling axially back and forth, the piston having a piston nose positioned at an axially bottom end thereof;

a top working chamber located at a top end of the piston and a bottom working chamber located at the bottom end of the piston;

a driver sub provided with a set of axially extending driver sub splines on an internal surface thereof;

a drill bit having a central bore extending axially therethrough and including an elongate shank provided with a set of axially extending shank splines on an outer surface thereof for engagement with the driver sub splines to form a spline area;

a guide sleeve arranged for forming a first seal with the piston nose, wherein the guide sleeve has an inner surface and an outer surface, wherein the guide sleeve forms a second seal with the outer surface of the shank of the drill bit; and at least one air passageway extending through the guide sleeve and the casing or just the casing for fluidly connecting the bottom chamber to the spline area to provide lubrication thereto, wherein the guide sleeve has a first section at the axial top end, a second section in an axial central region and a third section at the axial bottom end and wherein the air passageway is formed from:

at least one top end port located in the first section that extends from a first distal end on an inner surface of the guide sleeve to a second distal end on the outer surface of the guide sleeve and wherein the first distal end is fluidly connected to the bottom chamber;

at least one channel positioned in the second section formed between an inner surface of the casing and the outer surface of the guide sleeve that is fluidly connected to the at least one top end port; and at least one groove positioned in the outer surface of the third section or at least one bottom end port extending through the third section that is fluidly connected to the channel and the spline area.

2. The drilling assembly according to claim 1, wherein the first seal and/or second seal is strengthened with an additional sealing medium selected from a piston seal or a rod seal.

3. The drilling assembly according to claim 1, wherein there are at least three top end ports.

4. The drilling assembly according to claim 1, wherein the top end ports are evenly spaced around a circumference of the guide sleeve.

5. The drilling assembly according to claim 1, wherein the at least one top end port projects at an angle such that the first distal end is nearer the top end of the guide sleeve compared to the second distal end.

6. The drilling assembly, according to claim 1, wherein the at least one channel is formed by the outer surface of the guide sleeve and being recessed radially inwardly around an entire circumference of the guide sleeve.

7. The drilling assembly, according to claim 1, wherein the at least one channel is formed by axial sections of the outer surface of the guide sleeve being recessed radially inwardly.

8. The drilling assembly, according to claim 1, wherein there are at least two grooves or bottom end ports.

9. The drilling assembly according to claim 1, wherein the air passageway is formed from at least one top end port located in the first section of the guide sleeve and a recess on the inner side of the casing.

10. The drilling assembly according to claim 1, wherein the air passageway extends exclusively through the casing via the recess on the inner side of the casing.

11. The drilling, according to claim 1, wherein the driver sub and/or drill bit has a slot adjacent to a gap between the shank of the drill bit and the driver sub for the air from the spline area to leak through to the outside of the assembly.

* * * * *